US007046221B1

(12) United States Patent
Malzbender

(10) Patent No.: US 7,046,221 B1
(45) Date of Patent: May 16, 2006

(54) INCREASING BRIGHTNESS IN FIELD-SEQUENTIAL COLOR DISPLAYS

(75) Inventor: Rainer M Malzbender, Niwot, CO (US)

(73) Assignee: Displaytech, Inc., Longmont, CO (US)

( * ) Notice: Subject to any disclaimer, the term of this patent is extended or adjusted under 35 U.S.C. 154(b) by 172 days.

(21) Appl. No.: 09/974,437

(22) Filed: Oct. 9, 2001

(51) Int. Cl.
*G09G 3/32* (2006.01)

(52) U.S. Cl. ..... 345/82; 345/102

(58) Field of Classification Search ..... 345/82–83, 345/88–89, 32, 33, 39, 102
See application file for complete search history.

(56) References Cited

U.S. PATENT DOCUMENTS

| | | | | |
|---|---|---|---|---|
| 2,295,443 | A | 9/1942 | Wilson | 178/5.2 |
| 2,317,989 | A | 5/1943 | Goldmark | 178/5.2 |
| 2,466,021 | A | 4/1949 | Goldmark | 178/5.4 |
| 2,493,200 | A | 1/1950 | Land | 88/112 |
| 2,878,309 | A | 3/1959 | Christensen | 178/5.4 |
| 2,880,267 | A | 3/1959 | Goldmark, et al. | 178/5.4 |
| 4,600,274 | A | 7/1986 | Morozumi | 350/339 |
| 4,907,862 | A * | 3/1990 | Suntola | 349/61 |
| 5,233,385 | A | 8/1993 | Sampsell | 355/35 |
| 5,448,314 | A | 9/1995 | Heimbuch et al. | 348/743 |
| 5,528,393 | A | 6/1996 | Sharp | 359/53 |
| 5,654,756 | A * | 8/1997 | Takahashi et al. | 348/268 |
| 5,668,572 | A | 9/1997 | Meyer | 345/150 |
| 5,680,180 | A | 10/1997 | Huang | 348/656 |
| 5,686,931 | A | 11/1997 | Funfschilling et al. | 345/88 |
| 5,751,384 | A | 5/1998 | Sharp | 349/18 |
| 5,777,694 | A | 7/1998 | Poradish | 348/743 |
| 5,777,707 | A * | 7/1998 | Masaki et al. | 349/110 |
| 5,863,125 | A | 1/1999 | Doany | 353/84 |
| 5,921,650 | A | 7/1999 | Doany et al. | 353/31 |
| 5,969,868 | A | 10/1999 | Bornhorst et al. | 359/589 |
| 6,002,452 | A | 12/1999 | Morgan | 348/742 |
| 6,091,462 | A | 7/2000 | Sharp et al. | 349/19 |
| 6,097,367 | A * | 8/2000 | Kuriwaki et al. | 345/589 |
| 6,108,053 | A | 8/2000 | Pettitt | 348/743 |
| 6,115,016 | A * | 9/2000 | Yoshihara et al. | 345/88 |
| 6,151,004 | A * | 11/2000 | Kaneko | 345/88 |
| 6,208,393 | B1 | 3/2001 | Bawolek et al. | 349/106 |
| 6,243,148 | B1 * | 6/2001 | Kaneko et al. | 349/61 |
| 6,256,073 | B1 | 7/2001 | Pettitt | 348/743 |

(Continued)

OTHER PUBLICATIONS

A. Kunzman, G. Pettitt, Texas Instruments, "White Enhancement for Color Sequential DLP," published in the 1998 SID Digest, p. 121.

(Continued)

*Primary Examiner*—Sumati Lefkowitz
*Assistant Examiner*—Alecia D. Nelson
(74) *Attorney, Agent, or Firm*—Robert G. Crouch; Marsh, Fischmann & Breyfogle LLP

(57) ABSTRACT

A display system includes a display panel having an array of pixels, the pixels having ON states and OFF states. The pixels form images by modulating light in a temporal sequence during an image frame in response to drive signals generated from incoming video data. A light source arrangement that emits at least two colors of light illuminates the display panel. The image frame is divided into color segments with only one color of light being emitted from the light source during each segment. The color segments are further divided into grayscale periods. Transition segments are provided for the transitions between colors. The state of each pixel during these transition segments is a function of the desired brightness level for each pixel, as derived from incoming video data.

21 Claims, 6 Drawing Sheets

U.S. PATENT DOCUMENTS

| | | | | |
|---|---|---|---|---|
| 6,256,425 | B1 | 7/2001 | Kunzman | 382/274 |
| 6,309,071 | B1 | 10/2001 | Huang et al. | 353/31 |
| 6,324,006 | B1 | 11/2001 | Morgan | 348/743 |
| 6,392,620 | B1 * | 5/2002 | Mizutani et al. | 345/88 |
| 6,392,717 | B1 | 5/2002 | Kunzman | 348/744 |
| 6,417,892 | B1 | 7/2002 | Sharp et al. | 348/742 |
| 6,490,017 | B1 | 12/2002 | Huang et al. | 349/97 |
| 6,570,554 | B1 * | 5/2003 | Makino et al. | 345/102 |
| 6,768,481 | B1 | 7/2004 | Ozawa et al. | 345/87 |

OTHER PUBLICATIONS

A.N. Brinson, A.D. Edgar, "Liquid Crystal Aparatus for Converting Black and White CRT Display into Colored Display," published in the IBM Technical Disclosure Bulletin vol. 22, No. 5, Oct. 1979.

P.C. Goldmark,J.N. Dyer, E.R. Piore, J.M. Hollywood, "Color Television—Part I," published in Proceedings of the I.R.E., Apr. 1942.

* cited by examiner

INCREASING BRIGHTNESS IN FIELD-SEQUENTIAL COLOR DISPLAYS

This invention relates generally to field-sequential color displays and more particularly to methods and arrangements for increasing the brightness of such displays by more efficiently utilizing the light from a light source.

BACKGROUND OF THE INVENTION

Microdisplays are becoming increasingly popular as low cost, low power consumption, yet high resolution replacements for traditional information display components such as cathode-ray tubes. Their small size allows integration into hand-held products, such as camcorders and digital still cameras, while their high resolution capabilities promote usefulness in projection applications, such as televisions and business projectors.

The usefulness of microdisplays in projection applications depends greatly on the system's ability to project a sufficiently bright image. However, certain types of microdisplays, liquid crystal microdisplays in particular, require optical elements such as polarizers or diffusers that reduce the amount of light that reaches the viewing area. Moreover, the algorithms used to operate microdisplays to produce images also may result in wasted light, as will be explained immediately below.

Field-sequential color microdisplays produce color images by dividing an image frame into color segments. An image frame is a period of time during which the information necessary to produce a single image is displayed on the display device. A color segment is a portion of a frame during which the image information for a single color is displayed while the display is illuminated with that single color of light. Field-sequential color displays can be contrasted with non-sequential color systems, which usually combine three different color images simultaneously. By using the three primary colors, red, green and blue (RGB), in sequence, a field-sequential color display is capable of producing images from a palette of many colors. The size of the color palette is further increased by adding grayscale.

Grayscale refers to "shading" colors—varying the amount of each primary color included in the image—thus increasing the number of combined colors the system is capable of producing. Field-sequential color systems produce grayscale in one of several ways. One method is to vary the intensity of light either reflected by or transmitted through the device. A second method is to vary the duration of time that the light is reflected or transmitted. Methods for producing grayscale in microdisplays are well known. For example, U.S. Pat. No. 5,748,164, issued May 5, 1998, entitled Active Matrix Liquid Crystal Image Generator, describes various methods for producing gray-scale images in field-sequential color microdisplays, which patent is incorporated herein by reference in its entirety.

In prior art methods of producing gray-scale images in field-sequential color systems, light may be underutilized. For instance, because image information cannot be written to the entire display as fast as the light source can be switched to a different color, color transitions can result in image artifacts unless ameliorative steps are taken. One common ameliorative step is to make the display dark during the time that the light source is switched to a different color. Unfortunately, any light emitted while the display is dark is essentially wasted.

Light may also be wasted even if image information can be written to the entire display as fast as, or faster than, the light source can be switched to a different color. Most methods of switching a light source between colors do so in a finite amount of time, producing intermediate states of illumination that are either of a different color or a different intensity from the desired pure colors before and after the transition. For example, a color wheel that transitions between red and green will produce yellow light during the transition. A liquid crystal color switch may avoid such intermediate colors but will then produce intermediate light of varying intensity. In both cases the intermediate light is generally considered unusable directly by the display element in a field sequential color system designed to operate with primary colors of a single intensity. Again, a common ameliorative step is to make the display dark during the transition.

Light is also wasted in liquid crystal display systems that use a compensator cell while DC balancing the liquid crystal material. Compensators are more fully explained in U.S. Pat. No. 6,075,577, issued Jun. 13, 2000, entitled Continuously Viewable, DC Field-Balanced, Reflective Ferroelectric Liquid Crystal Image Generator, which patent is incorporated herein by reference in its entirety. DC balancing is desirable to prevent image sticking or image retention. It is achieved by inverting the electrical polarity sense of the pixel drive voltage. In the case of liquid crystal displays incorporating polarity responsive liquid crystal materials such as ferroelectric liquid crystals, reversing the electrical polarity sense of the pixel drive inverts the appearance of the image. In such cases, a compensator may be used to allow the inverted image to be displayed without affecting the appearance of the image at the image area. However, as with changing the color of the light source, the compensator can be switched much faster than data can be written over the entire display. Thus, to avoid image artifacts, one prior art solution is to make the display dark during a compensator transition.

A number of additional factors similar to those briefly discussed above also result in inefficient use of the available light in field-sequential color display systems. It is against this backdrop and a desire to solve the problems of the prior art, including a desire to increase the brightness of field-sequential color displays, that the present invention has been developed.

SUMMARY OF THE INVENTION

The present invention relates generally to a display for producing modulated light so as to form an image during a frame. The display includes a display panel having a plurality of pixels configured to modulate light in a temporal sequence. The pixels have a plurality of light modulating states, including OFF and ON. The display also includes a light source arrangement that illuminates the display panel, the light source arrangement being configured to selectively emit light of at least one of at least two different colors. The display also includes a data ordering arrangement that is receptive of incoming video data and that generates drive signals that drive the pixels to the light modulating states. The frame is divided time-wise into color segments with only one of the different colors of light being emitted from the light source arrangement during each color segment. The color segments are separated in time by transition periods during which more than one color of light may illuminate the panel. The incoming video data includes information from which the data ordering arrangement determines pixel brightness values for each color segment. The drive signals cause individual pixels to be in the same state during each transition period of a frame. The state of a pixel during the transition periods is determined by the pixel brightness values. Pixels with pixel brightness values above predetermined values for each color segment in a given frame are in a state other than OFF during the transition periods corresponding to the frame.

The number of color segments may be at least three. The light source arrangement may illuminate the panel with red light during one color segment, green light during a different color segment and blue light during a different color segment. The light source arrangement may illuminate the panel with at least two different colors during a transition period. The intensity of the different colors of light illuminating the panel during the transition periods may be adjustable to maintain a stable white point.

The display may also include a temperature sensing arrangement that senses the temperature of the light source arrangement. The intensity of the different colors of light illuminating the panel during the transition periods may be adjustable to maintain a stable white point in response to the temperature of the light source arrangement. The light source arrangement may include color filters. The light source arrangement may include a color wheel. The color wheel may be divided into at least three color areas. The color wheel may include red, green and blue color areas. The color wheel may include at least one broadly-transmissive area that passes a substantial amount of light across the visible light spectrum. The color wheel may include at least one broadly-transmissive area between each color area. The light illuminating the panel during a transition segment may travel through a broadly-transmissive area of the color wheel.

The display may also include a compensator cell having at least two states, one state wherein the compensator has no effect on the appearance to a viewer of individual pixels, and a second state wherein the compensator changes the appearance of pixels by inverting the contrast of the image. The compensator may change from the first state to the second state at least once during the frame. The compensator may change state during the color segment during which the light source is illuminating the display panel with blue light.

The present invention also relates to a display with a display panel. The panel has a plurality of pixels configured to modulate light in a temporal sequence so as to form an image during a frame. The pixels have a plurality of light modulating states, including OFF and ON. The display also includes a light source arrangement that illuminates the display panel. The light source arrangement is configured to selectively emit light of at least one of at least two different colors. The display also includes a data ordering arrangement that is receptive of incoming video data and that generates drive signals that drive the pixels to the light modulating states. The frame is divided time-wise into color segments with only one of the different colors of light being emitted from the light source arrangement during each color segment. The color segments include one or more grayscale periods. The incoming video data includes information from which the data ordering arrangement determines pixel brightness values for each color segment. The state of a pixel during each grayscale period is determined by the pixel brightness values for the corresponding color segment. Pixels with pixel brightness values above predetermined values for each color segment in a given frame are in a state other than OFF during corresponding grayscale periods of each color segment of the frame.

The present invention also relates to a display having a display panel. The panel has a plurality of pixels configured to modulate light in a temporal sequence so as to form an image during a frame. The display also includes a light source arrangement that illuminates the display panel. The light source arrangement is configured to selectively emit light of at least two different colors. The display also includes a compensator cell having at least two states, one state wherein the compensator has no effect on the appearance to a viewer of individual pixels, and a second state wherein the compensator changes the appearance of pixels by inverting the contrast of the image. The frame is divided time-wise into color segments with only one of the different colors of light being emitted from the light source arrangement during each color segment. The light source arrangement illuminates the panel with blue light during at least one color segment. The compensator changes from the first state to the second state at least once during the frame. The compensator may change state during the color segment during which the light source is illuminating the display panel with blue light.

The present invention also relates to a method of increasing the brightness of a display. The method includes providing a display panel having a plurality of pixels. The pixels have a plurality of light modulating states, including ON and OFF. The pixels are configured to modulate light in a temporal sequence so as to form an image during a frame. The method also includes providing a light source arrangement that illuminates the display panel. The light source arrangement is configured to selectively emit light of at least one of at least two different colors. The method also includes providing a data ordering arrangement that is receptive of incoming video data and that generates drive signals that drive the pixels to the light modulating states. The method also includes dividing the frame time-wise into a plurality of color segments. The method also includes inserting transition periods between each color segment. The method further includes determining pixel brightness values for each color segment from the incoming video data. The method also includes generating drive signals that cause individual pixels with pixel brightness values above predetermined values for each color segment in a given frame to be in a state other than OFF during each transition period of the frame. The method also includes illuminating the panel with only one of the different colors of light from the light source arrangement during a color segment. The method also includes illuminating the panel with at least one of the different colors of light from the light source arrangement during a transition period.

The number of color segments may be at least three. The panel may be illuminated with red light during one color segment, green light during a different color segment, and blue light during a different color segment. The panel may be illuminated with at least two different colors of light during a transition period.

The method may also include adjusting the intensity of the different colors of light illuminating the panel during the transition periods to maintain a stable white point. The method may also include providing a temperature sensing arrangement that senses the temperature of the light source arrangement and adjusting the intensity of the different colors of light illuminating the panel during the transition periods to maintain a stable white point in response to the temperature of the light source arrangement.

The light source arrangement may include color filters. The light source arrangement may include a color wheel. The color wheel may be divided into at least three color areas. The color wheel may include red, green and blue color areas. The color wheel may include at least one broadly-transmissive area that passes a substantial amount of light across the visible light spectrum. The color wheel may include at least one broadly-transmissive area between each color area. The light illuminating the panel during a transition segment may travel through a broadly-transmissive area of the color wheel.

The method may also include providing a compensator cell having at least two states, one state wherein the compensator has no effect on the appearance to a viewer of individual pixels, and a second wherein the compensator changes the appearance of pixels by inverting the contrast of the image. The compensator may change from the first state to the second state at least once during the frame. The method may also include changing the compensator state during the color segment during which blue light is illuminating the display panel.

The present invention also relates to a field-sequential grayscale color display system having a display panel. The display panel includes an array of pixels having a plurality of light modulating states. The display system also includes an illumination arrangement that illuminates the pixels. The illumination arrangement includes a color generating arrangement that produces light in at least three different color spectrum ranges. The illumination arrangement sequentially illuminates the panel with light from each one of the at least three different color spectrum ranges at a time during a frame. The light from the at least three different color spectrum ranges produces white light when combined. The display system also includes a pixel driving arrangement that is receptive of incoming video data and that produces grayscale pixel drive signals that drive individual pixels to light modulating states in accordance with a grayscale scheme. The pixel driving arrangement also produces compensation drive signals that cause each pixel to be in the same light modulating state during each of at least three compensation periods. One compensation period corresponds to each color spectrum range of light in the illumination sequence.

DETAILED DESCRIPTION

An invention is described herein relating to methods and systems for increasing brightness in field-sequential color display systems. In the following description, numerous specific details are set forth in order to provide a thorough understanding of the present invention. Based on the following description, however, it will be obvious to one skilled in the art that the present invention may be embodied in a variety of specific configurations. In addition, well-known processes for producing various components and certain well-known optical effects of various optical components will not be described in detail in order not to unnecessarily obscure the present invention.

The present invention applies to many display systems, including, for example, digital micro-mirror devices (DMDs) and liquid crystal devices (LCDs), including nematic, ferroelectric and antiferroelectric LCDs. However, for purposes of illustration, where necessary, the invention will be described herein as embodied in a ferroelectric liquid crystal microdisplay device. As will be readily apparent to one skilled in the art, the present invention should not be considered limited to ferroelectric liquid crystal devices specifically or even liquid crystal devices generally. Further, the present invention is not limited to microdisplays, as the teachings herein apply to most display systems using field-sequential color, as will become apparent in view of this detailed description.

Figure 1:
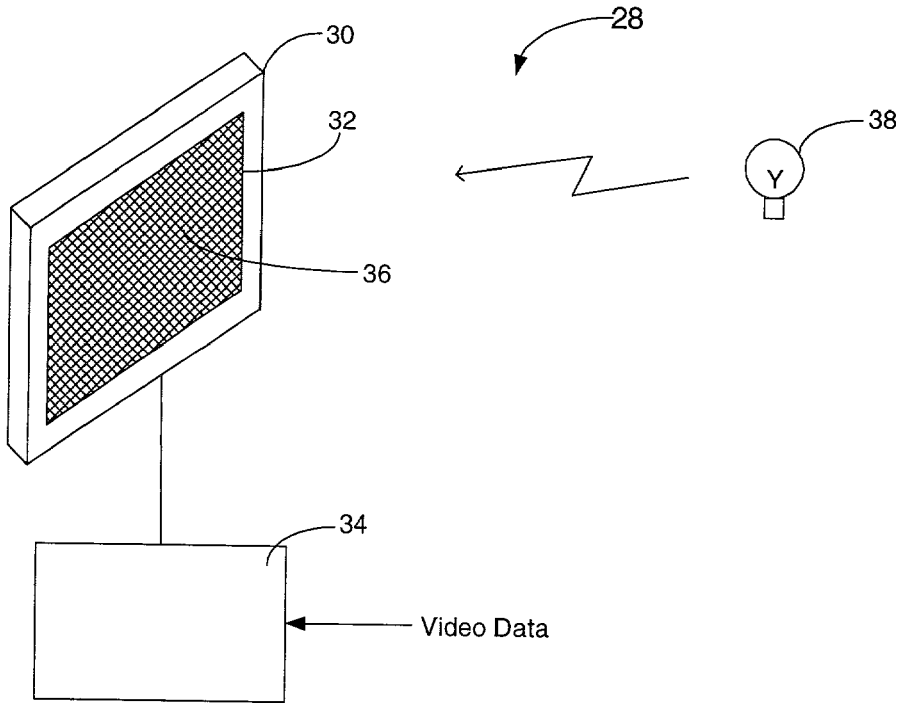
FIG. 1 is a perspective view of a simple display system based on a liquid crystal microdisplay, which may include and be operated according to the teachings of the present invention.

Attention is first directed to FIG. 1, which illustrates a simple microdisplay system 28. In FIG. 1 and all figures that follow, like reference numbers refer to like components between figures. The microdisplay system 28 of FIG. 1 includes a microdisplay panel 30 having an array of pixels 32. A data ordering arrangement 34 receives incoming video data and produces drive signals that cause individual pixels 36 of the pixel array 32 to assume various light modulating states. A light source arrangement 38 illuminates the microdisplay panel 30 with light of any of a number of color combinations. (Herein, "color" does not limit the description to a single wavelength in the color spectrum. For example, any number of different visible wavelengths of light may be present in what is perceived as a single color.) Typical color display systems include a light source arrangement 38 that illuminates the panel 30 with the three primary colors, red, green and blue, either in combination or in sequence. Although the present invention will be described with reference to a display system 28 having a light source arrangement 38 that illuminates the panel 30 sequentially with red, green and blue light (i.e., RGB field-sequential color), the present invention applies broadly to display systems having light source arrangements that illuminate the microdisplay panel 30 with any combination or sequence of at least two colors of light.

The light source arrangement 38 produces colored light in any of a number of different ways, some of which will be described in more detail hereinafter. For example, the light source arrangement 30 may include light emitting diodes (LEDs) that each emit light of a specific color, in which case the light source arrangement 38 would include at least two such devices to produce the at least two different colors. Alternatively, the light source arrangement may use a color wheel or color filter(s) in combination with a broad spectrum light emitting device. The color wheel or color filter(s) would include filtering components that each pass light of a specific color, in which case the light source arrangement 38 would include a color wheel or color filter(s) having at least two filtering components to produce the at least two colors.

Figure 2:
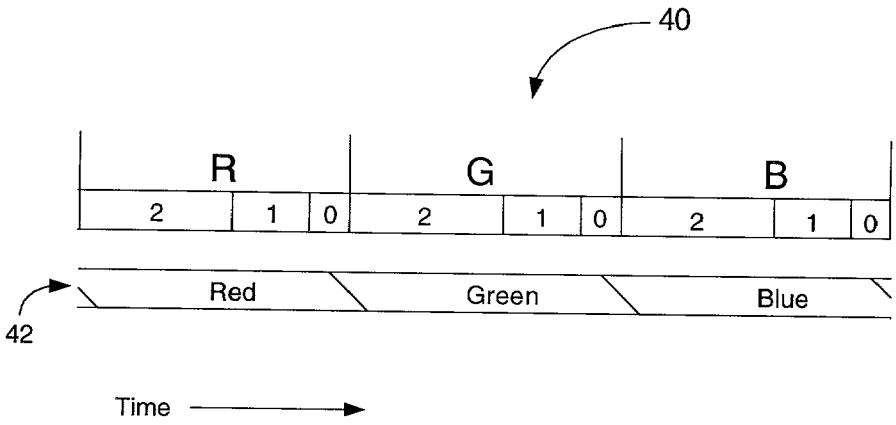
FIG. 2 is a timing diagram for a single frame in a field-sequential RGB color, 3-bit grayscale display system.

As previously stated, display system 28 includes a data ordering arrangement 34 that receives incoming video data and produces drive signals that cause individual pixels 36 of the pixel array 32 to assume various light modulating states. In binary state display systems, such as DMDs and most ferroelectric LCDs, the pixels typically have two states, ON and OFF. In other systems, such as nematic or antiferroelectric LCDs, the pixels may have any number of light modulating states. Microdisplay systems, such as system 28 of FIG. 1, produce color images by driving the pixels in a temporal sequence while illuminating the pixels with different colors of light. One such method of producing images in microdisplay systems is called field-sequential color. In a field-sequential color system, time is divided into frames, as illustrated in FIG. 2. FIG. 2 includes one frame 40 of pixel information timing in a field-sequential color system, such as system 28 of FIG. 1. Frames are typically on the order of $1/60^{th}$ of a second or shorter, because the human eye is capable of integrating into a single image a number of different images it perceives during such short time periods. The frame 40 is divided into color segments, during which a single color of light illuminates the pixels, except possibly during color transitions. In FIG. 2, the state of the light source arrangement (38 from FIG. 1) is indicated by bar 42. In this example, the frame 40 is divided into red, green and blue color segments, represented by R, G and B, respectively. Thus, the data ordering arrangement 34 converts the incoming video data into RGB drive signals.

The number of colors a microdisplay system is capable of producing may be increased beyond the number of different colors produced by the light source arrangement 38 by adding grayscale. Grayscale may be produced using any of a number of well known methods, including amplitude modulation, pulse-width modulation and binary pulse-width modulation. For instance, grayscale may be produced using amplitude modulation by driving the pixels to any light modulating state from fully ON to fully OFF for each color segment. The amplitude of the pixel drive signal determines the intensity of the light reflected by or transmitted through the pixel. Alternatively, grayscale may be produced using pulse-width modulation or binary pulse-width modulation. In both examples of pulse-width-modulated grayscale systems, the pixels are driven to the ON state for only a portion of each color segment. The amount of time the pixel is in the ON state determines the intensity of the light either reflected by or transmitted through the pixel during each color segment. Pulse-width-modulated grayscale may be produced using either analog or binary drive circuitry. In analog drive systems, each pixel typically is held in the ON state continuously during each color segment for a duration corresponding to the desired intensity of the pixel for that color segment. In binary drive systems, each color segment typically is divided into grayscale time periods having different durations corresponding to a binary coded system, and the pixel may be driven to either the ON or OFF state for each grayscale time period. Thus, regardless of the grayscale system used in combination with the present invention, the RGB data produced by the data ordering arrangement 34, represents the grayscale intensity of the pixel in each color segment in each frame. Although the present invention is applicable to display systems that produce grayscale according to any of these methods, as well as various hybrids thereof, for ease of illustration, the invention will be described herein with reference to a binary pulse-width-modulated grayscale system.

In the example of FIG. 2, the binary grayscale field-sequential RGB color system includes 3 bits of grayscale. Thus, each color segment is divided into three grayscale periods, which are labeled 2, 1 and 0. Grayscale period 1 is twice as long as period 0, and period 2 is twice as long as period 1 in each color segment. A pixel may be either ON or OFF for each grayscale period of each color segment. Thus, in this example of a 3-bit grayscale system, each color segment can produce 8 different shades of that color. Further, because a person viewing the image perceives all color segments within a frame as a single image, the image may contain 8×8×8=512 different colors. While FIG. 2 illustrates a relatively simple field-sequential color, 3-bit grayscale system, useful microdisplay devices typically operate using more complex systems to overcome some limitations, as will be explained immediately hereinafter.

Figure 3:
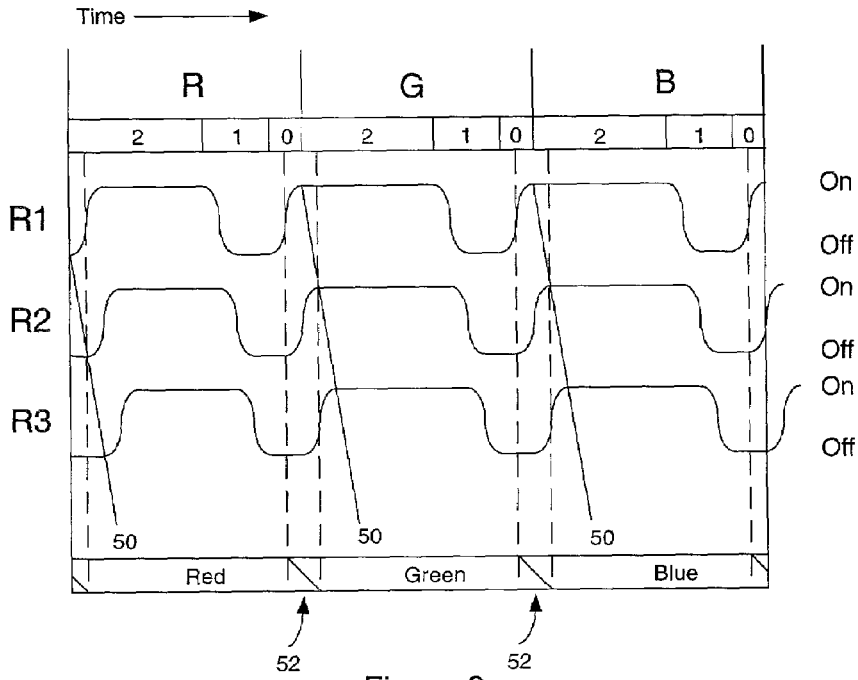
FIG. 3 is a timing diagram showing the state of three pixels, one on each of three different rows, in a field-sequential RGB color, 3-bit grayscale display system.

A microdisplay panel such as panel 30 contains an array of pixels 32, as explained above with reference to FIG. 1. The pixels are arranged into rows and columns. The data ordering arrangement 34, in this simplified example, sends drive signals to pixels on a row-by-row basis, causing the pixels to be in either the ON or OFF state for each grayscale period of each color segment of each frame. Due to bandwidth limitations, it is not always possible in most practical designs to write different information to various pixels in the array simultaneously. However, when a light source changes from one color to the next color, the color change may occur across the entire panel at once. Thus, the problem arises that some pixels will be displaying data for the next color segment while being illuminated with light for the current color segment, or vice versa. This situation is further explained in previously incorporated U.S. Pat. No. 5,748,164 and is illustrated in FIG. 3. Further, even in systems incorporating a feature that allows all pixels to be written with new data simultaneously (a feature herein referred to as "global update"), an illumination system that illuminates the display panel with a transition color or intensity different from the primary colors used for illumination, may cause the pixels to display incorrect information during the transitions.

FIG. 3 illustrates a timing diagram for a single frame of data in a 3-bit binary grayscale, field-sequential color system. The system has three color segments, red, green and blue, represented by R, G and B, respectively. Each color segment is divided into three grayscale bits, 2, 1 and 0. FIG. 3 further illustrates the pixel state of three hypothetical pixels on three different rows, R1, R2 and R3, of a pixel array. For this example, it will be assumed that R1 is the top most row, R2 is the middle row and R3 is the bottom row of the pixel array. Also in this example, drive signals are sent to the pixel array from a data ordering arrangement starting at the top of the array and working row-by-row to the bottom of the array.

In this diagram, each color segment of each pixel has a grayscale value of 5. A single value has been chosen for purposes of illustration to simplify the example. In a 3-bit binary grayscale system, 5 is represented by bit 2 being ON, bit 1 being OFF and bit 0 being ON.

The pixel in row R1 receives the bit 2 drive signal first, as can be appreciated by observing the timing diagram of FIG. 3. The state of the pixel in R1 begins to change at the beginning of the bit 2 time period of the red color segment. In this example, and in most cases in typical microdisplays, the pixel does not change instantly—it has a non-negligible response time to the drive signal. Therefore, the pixel is not fully ON until some point in time after it receives the ON signal. The pixel in row R2 receives its bit 2 drive signal after the pixel in row R1 receives its bit 2 drive signal for each respective color segment. The pixel in row R3 receives its bit 2 drive signal last for each color segment. The difference in time by which each pixel in the different rows receives its bit 2 drive signal is shown by line 50. The delay is consistent across different color segments in the timing diagram. The time interval between the dashed lines, indicated by reference numeral 52, is the transition period, during which the light source arrangement is changing from one color to the next. During this time, more than one color may illuminate the display panel and/or the panel may be illuminated with light having a different intensity than the light that illuminates the panel during non-transition periods.

As can be appreciated with reference to FIG. 3, each of the three pixels exhibits a different response during the transition periods 52. Although all pixels should appear to display the same data during the frame (because we have selected the same data for each pixel in this example), the delayed writing time across the panel causes the pixel in R1 to appear more red than the pixel in R3 because it is in the ON state for a greater portion of the red color segment. A similar problem occurs at each transition period 52 in the frame. This condition results in color inaccuracies that degrade the quality of the image and the usefulness of the device.

Figure 4:
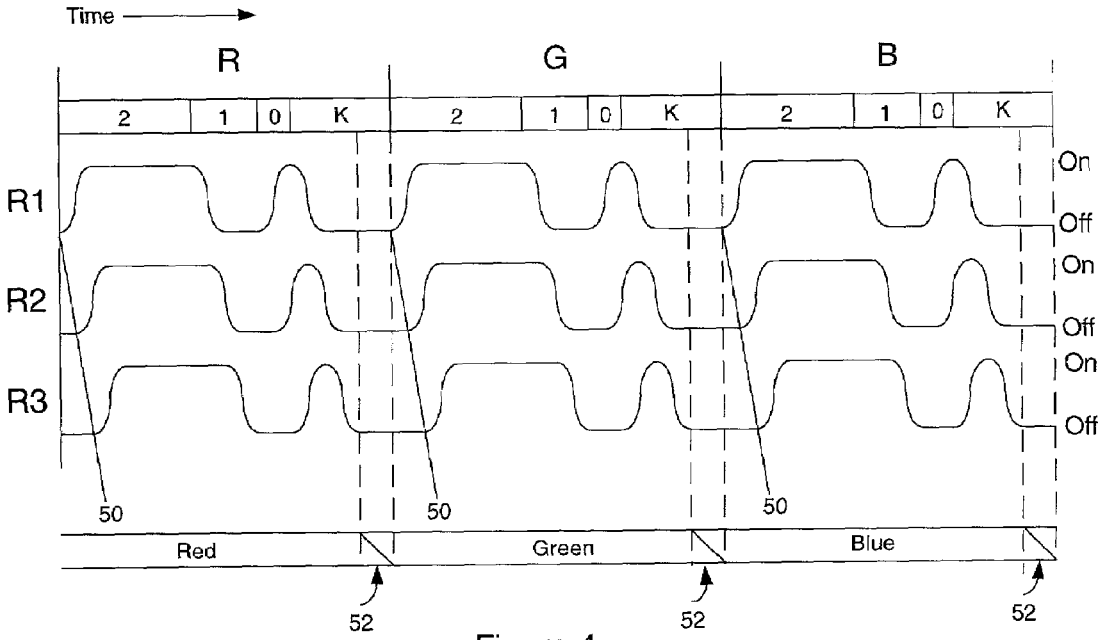
FIG. 4 is a timing diagram showing the state of three pixels, one on each of three different rows, in a field-sequential RGB color, 3-bit grayscale display system, including a transition segment bit that is always off.

One possible solution to overcome this problem is illustrated in FIG. 4, which depicts a similar timing diagram for the same pixels. The system of FIG. 4 overcomes the aforementioned problem of FIG. 3 by making all pixels across the entire panel OFF during the transition periods 52 in the following way. In the field-sequential color, 3-bit grayscale system of FIG. 4, an additional grayscale bit is inserted between the grayscale bits of each color segment. This additional grayscale bit is shown as bit K (for blacK). The value of bit K is always 0, which causes black to be written to the panel. The duration of bit K is approximately the amount of time it takes to write the entire panel with data, plus the amount of time the light source arrangement takes to fully transition between colors. Thus, the transition periods 52 that occur while the pixels are displaying bit K data occur while the display appears dark, and no color inaccuracies result. However, useable light is wasted, because the display is dark during every color transition of every frame, and the display does not appear as bright as it otherwise could. The present invention improves upon this limitation.

Figure 5:
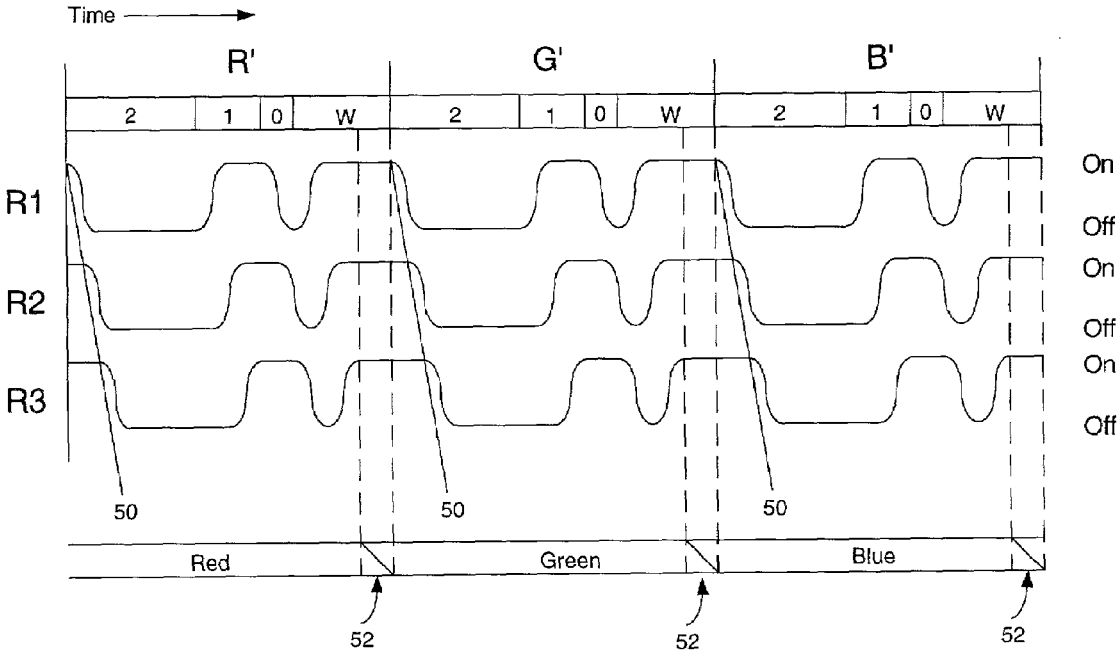
FIG. 5 is a timing diagram showing the state of three pixels, one on each of three different rows, in a field-sequential RGB color, 3-bit grayscale display system, including a transition segment bit whose state is determined according to the teachings of the present invention.

Attention is now directed to FIG. 5, which illustrates a 3-bit grayscale, field sequential color system according to the present invention. In this example, W (White) bits are inserted between the grayscale bits of each color segment, and the RGB color segments are designated as R', G' and B' color segments. W bits are not necessarily the opposite of K bits, as will be explained below; however, this representation indicates that the system displays the image data differently than in the previous example of FIG. 4. In this example, the data ordering arrangement performs a different data transformation on the incoming video data. Instead of generating RGB data, the data ordering arrangement generates R'G'B'W data. The data ordering arrangement then sends the R' data to the panel during the R' color segment, the G' data during the G' color segment, and the B' data during the B' color segment. However, the data ordering arrangement sends the W data to the panel during each transition period 52 in a given frame. That is, for a given frame and pixel, the same W data is displayed during each transition period 52 of the frame. Thus, although possible depending on the result of the data transformation, it is not necessary for each pixel to be dark during color transitions. Color inaccuracies that result from pixels on different rows being in different states during transition periods are hidden, as are the color inaccuracies that result from the light source arrangement projecting light other than a pure primary color, because the same inaccuracies are repeated for each transition period 52. Because such inaccuracies are repeated for each transition period 52, the resultant optical effect is either black or white during the combined transition periods 52, because equal intensities of red, green and blue light combine to form white light. In other words, the integrated optical result of only the transition periods 52 in a frame is that the pixels reflect white light of a certain intensity if the data transformation resulting in R'G'B'W data requires the W bit to have an intensity other than zero, or the pixels do not reflect any light, if the W bit has zero intensity.

In addition to not being necessary for all pixels to be OFF during each transition period 52, it is also not necessary for all pixels in the array to display the same data during the color transitions 52, as was the case in the example of FIG. 4. Different pixels across the display may have different W bit values for a given frame. Additionally, the W bit for each pixel may be any grayscale value from fully OFF to fully ON, depending on the grayscale arrangement (e.g., amplitude modulated, pulse-width modulated, or binary pule-width modulated) of the system. An example follows.

Figure 6:
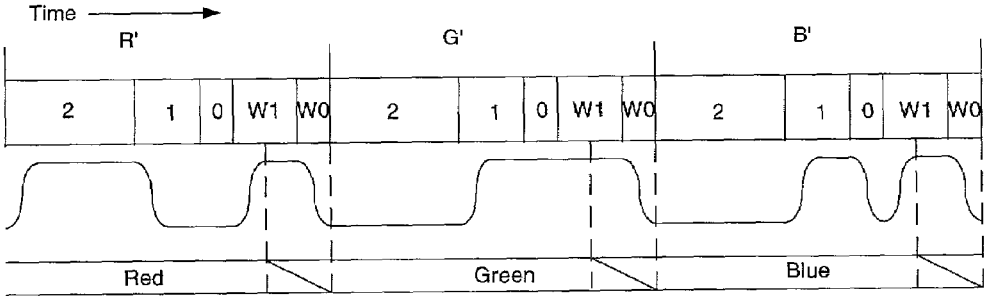
FIG. 6 is a timing diagram showing the state of a single pixel in a field-sequential RGB color, 3-bit grayscale system, including a transition period bit having 2 bits of gray scale, the states of which are determined according to the teachings of the present invention.

FIG. 6 illustrates a timing diagram for a single frame in a binary pulse-width modulated grayscale, field-sequential color R'G'B'W system. In this example, the W information is contained in two bits of grayscale, W1 and W0. Thus, W may have four different values, in this example. If additional W values are desirable, additional grayscale W bits could be added. Similarly, in either amplitude-modulated or pule-width modulated grayscale systems, bit W could have values ranging from fully OFF to fully ON.

The immediately preceding example of FIG. 6 discloses another important aspect of the present invention. That is, it is not a requirement that no pixels transition while the light source arrangement transitions between colors. For example, if bit W1 is ON and bit W0 is OFF (i.e., W value 10 (binary) or grayscale level 2) for a given pixel during each color segment of a given frame, it is acceptable for the light source arrangement to transition to a different color while the state of the pixel transitions from W1 to W0 because the transition will be the same during each color segment of the frame.

The transformation of incoming video data to R'G'B'W data may be accomplished according to a number of well known methods. Examples may be found, for instance, in copending U.S. patent application Ser. No. 09/923,920, filed Aug. 17, 2001, entitled, Color-Balanced Enhancement for Display Systems, which application is incorporated herein by reference in its entirety. Other examples may be found in U.S. Pat. No. 6,256,425, issued Jul. 3, 2001, entitled, Adaptive White Light Enhancement for Displays, which patent is incorporated herein by reference in its entirety. The data ordering arrangement essentially evaluates the red, green and blue intensity information for each frame for a given pixel, and, if each color requires sufficient intensity, the data ordering arrangement places some of the intensity from each color in the W period, instead of the respective color segment.

The present invention is not limited to inserting W bits only between color segments; it may be desirable to place W bits in the middle of a color field for various reasons. For instance, some binary pulse-width-modulated grayscale algorithms (especially those involving multiple subpixels) result in "leftover" grayscale time periods when balancing the number of periods in a frame. Heretofore, such periods were written with OFF data, resulting in wasted light. However, in light of the present invention, leftover grayscale periods in RGB field-sequential color systems may be written with W data, which may be either ON or OFF, provided the W data is written to the pixel in each color segment in a frame.

Figure 7:
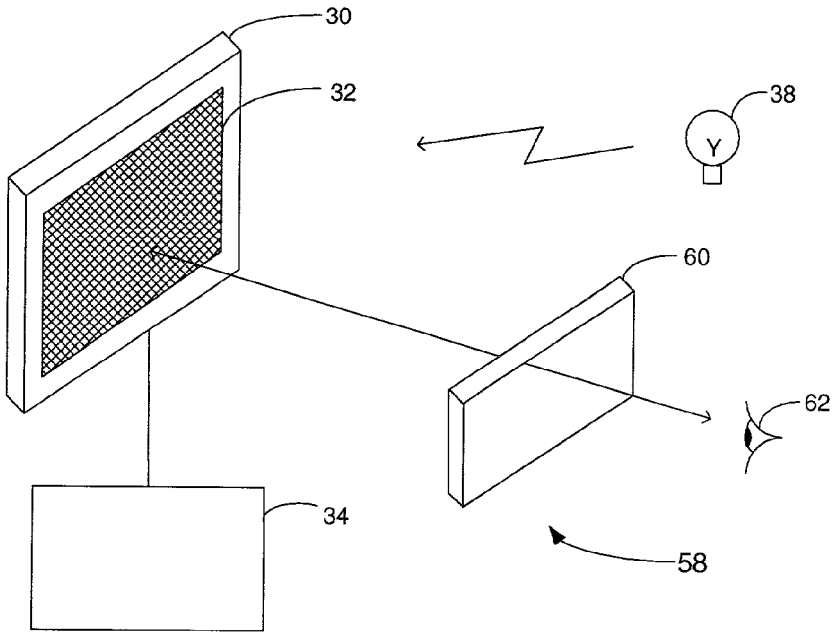
FIG. 7 is a perspective view of a simple display system based on a liquid crystal microdisplay and a compensator, which may include and be operated according to the teachings of the present invention.

The dark display at color transitions was also used previously to mask other events. For instance, some display systems, ferroelectric liquid crystal display systems in particular, use "compensator" cells to DC-balance the liquid crystal material without blocking the light. FIG. 7 depicts a simple display system 58, which includes a compensator 60 placed between the panel 30 and a viewing area 62. A compensator is an optical device that alters the polarization of light that passes through it. Compensators are more fully explained in previously incorporated U.S. Pat. No. 6,075,577. Compensator transitions were located at a color transition so that the compensator could be switched while the display was dark. However, because the display is no longer necessarily dark at color transitions according to the present invention, the compensator transition may be located elsewhere.

Figure 8:
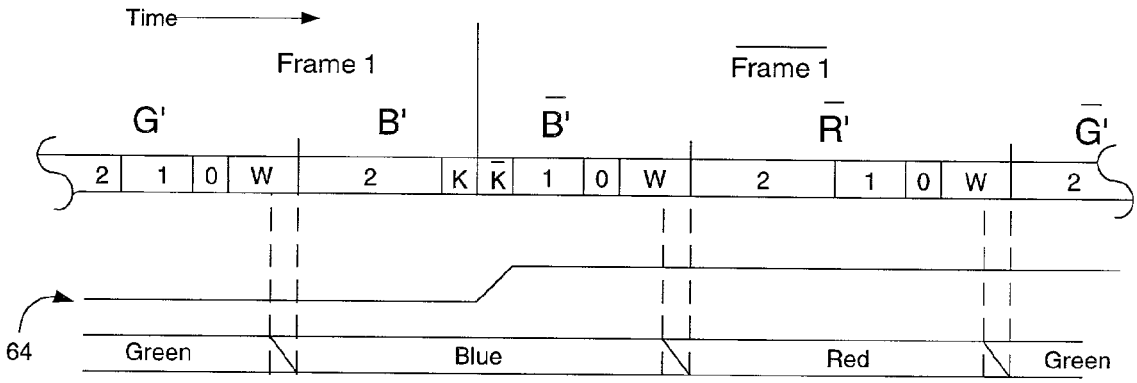
FIG. 8 is a timing diagram for a partial frame in a field-sequential RGB color, 3-bit grayscale display system, including a compensator operated in accordance with the teachings of the present invention.

Attention is directed to FIG. 8, which illustrates the compensator transition taking place during the blue color segment of a frame. In RGB systems that use a compensator, it is difficult to perfectly align in time the transition of the compensator with inversion of the image appearance by the microdisplay panel. Therefore, a small flash of light usually results during compensator transitions. It has been discovered to be advantageous to locate the compensator transition in the blue color segment, since the viewer will not be as disturbed by a brief flash of blue light as the viewer would be by either a red or green flash of light. This is because the human eye is less sensitive to blue light than either red or green light. Thus, the present invention locates the compensator transition within the blue color segment.

FIG. 8 is a timing diagram depicting both a partial frame of image data and the compensator state 64. In FIG. 8, a bar above the text indicates that the appearance of the image information is inverted. Thus, in Frame 1 bar (inverted), the image information displayed is inverted with respect to Frame 1. However, because the compensator is in the opposite state during Frame 1 bar, the appearance of the image at the viewing area remains unchanged. The compensator transition takes place during the blue color segment. The panel is written with black or OFF data, as indicated by bit K. Then the compensator state is changed as the panel is written with K bar or ON data. As a result, the panel continues to appear dark at a viewing area after the compensator transition. Any light the leaks through to the viewing area during the compensator/panel transition will appear as a brief flash of blue light, which is less disturbing to a viewer than a brief flash of either red or green light.

Figure 9:
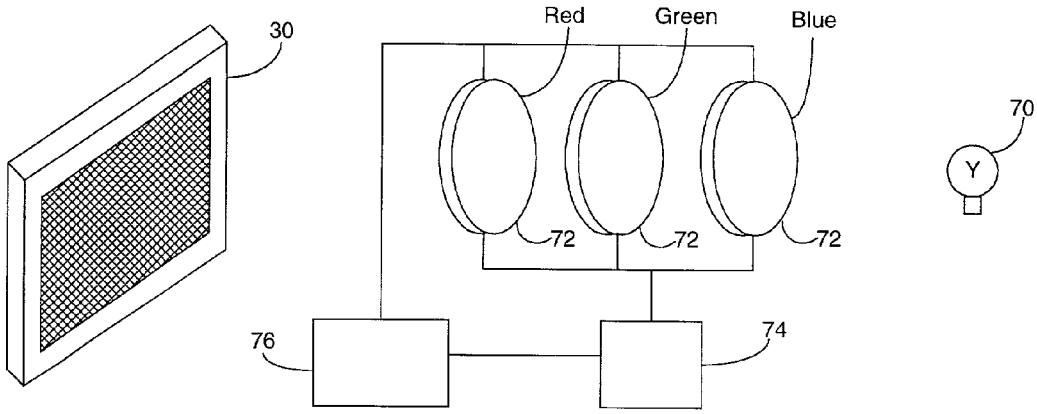
FIG. 9 is a perspective view of a simple display system based on a liquid crystal microdisplay and a series of color filters included in the light source arrangement, which may include and be operated according to the teachings of the present invention.

The present invention may be embodied in display systems that use any one of a number of different types of light source arrangements. For example, the system may use either color filters or color wheels in a number of advantageous ways. Attention is now directed to FIG. 9, which illustrates a system that uses a single, broad spectrum light source device 70 in combination with a number of switchable color filers 72 arranged in series. (Color filters are more full explained in WIPO International Publication No. WO 01/09668 A1, published Feb. 8, 2001, entitled Color Filters, Sequencers and Displays Using Color Selective Light Modulators, which publication is incorporated herein in its entirety.) In this example, the system uses red, green and blue color filters. The color filters are switched by electrical signals from a color sequencer 74 that causes a particular color filter to be active during the corresponding color segment of each image frame. The red color filter can selectively block or pass red light, but has no effect on either green or blue light. The green and blue filters operate similarly on green and blue light, respectively.

Figure 10:
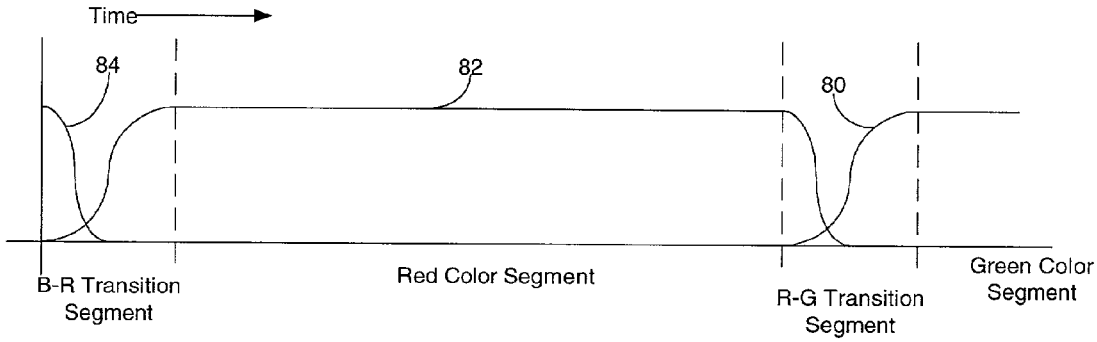
FIG. 10 is a first timing diagram depicting the state of the light source arrangement for a partial frame in a field-sequential RGB color display system, including light source devices having non-negligible ON and OFF transition times, operated according to the teachings of the present invention.

Color filters have a non-negligible switching time to change between the passive, light-blocking state and the active, light-transmitting state. Also, the time the color filter takes to fully transition from the active state to the passive state may be different than the time the color filter takes to transition from the passive state to the active state. FIG. 10 illustrates the state of the light source arrangement over a partial image frame. It depicts the state of the red color filter during the red color segment and the blue-to-red (B-R) and red-to-green (R-G) transition segments, as well as the state of the green color filter during the R-G transition segment. In this example, the green color filter begins to turn ON as soon as the red color filter begins to turn OFF, as can be seen by lines 80 and 82, representing the state of the green and red color filters, respectively. Heretofore, the state of the color filters during a transition segment had no effect on the image, since all pixels were in the OFF state during color transitions. However, the present invention increases the brightness of the image by utilizing otherwise wasted light during the transition segments by making the W bits either ON or OFF, depending on the pixel image data. Therefore, the state of the color filters during transition segments is relevant in the present invention. In this example, light represented by the portions of lines 80 and 82 during the transition segments would cause pixels having ON W bits to appear ON at the viewing area. However, because each color filter may have different ON and OFF transitions times, the combination of light across all color segments in a particular frame may not appear to be the desired shade of white. Therefore, additional considerations are necessary.

Figure 11:
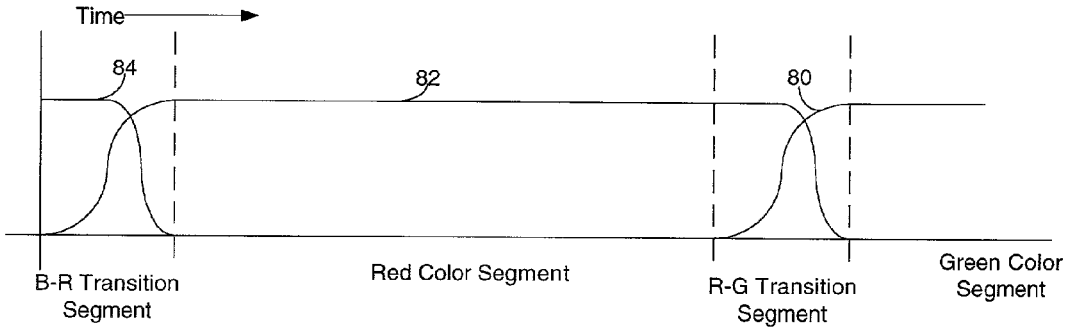
FIG. 11 is a second timing diagram depicting the state of the light source arrangement for a partial frame in a field-sequential RGB color display system, including light sources having non-negligible ON and OFF transition times, operated according to the teachings of the present invention.

FIG. 11 illustrates a second example of the state of the light source arrangement over time. In this example, the red and green color filters are both active for a longer period of time during the R-G transition segment, as is evident from lines 80 and 82. As a result, more light from two different color filters illuminates the display panel during the transition segment. This arrangement, in combination with having some pixels in the on state during the transition segment, increases the brightness of the image over the situation depicted in FIG. 10. FIG. 11 also illustrates the state of the blue color filter 84 during the blue-to-red (B-R) transition segment. During this transition segment, both the red and blue color filters are active. However, the degree of overlap between the blue and red color filters is not necessarily the same as with the red and green color filters. The degree of overlap may be adjusted for each color transition in a frame such that the combination of all color transitions across a single frame results in light of a desired color, in this case white light. Further, the degree of overlap may be adjusted to maximize the brightness of the display during the W bits. The degree of overlap is controlled by either advancing or delaying the time at which each color filter receives its ON and/or OFF signal from the color sequencer 74 of FIG. 9.

Color filters, as well as other light source arrangements, often have transition times that are affected by their temperature. In such cases, the degree of overlap may be adjusted to maintain the desired color of combined light in response to the temperature. This may be accomplished by using a temperature sensing arrangement 76 in FIG. 9 to sense the temperature of each color filter. The temperature sensing arrangement 76 provides information representing the sensed temperature to the color sequencer 74, from which the color sequencer determines the amount of time by which to advance or delay the ON and OFF signals to each color filter. The color sequencer 74 may accomplish the adjustment in a number of ways that are well known to those skilled in the art of electronic devices and will not be explained further.

Thus, the present invention greatly increases the brightness of a display image by more efficiently utilizing light during color transitions. Although this aspect of the present invention has been described with respect to color filters, it should not be considered limited to color filters. Any light source arrangement that includes light source devices having either negligible or non-negligible transition times may be used, and the system would enjoy the benefits of the present invention. For example, discrete light sources with nearly instantaneous ON and OFF times such as light emitting diodes (LEDs) could be used, in which case it may even be beneficial to have all LEDs in an RGB system ON for some portion of each color transition. Thus, any such light source should be considered within the scope of the present invention.

Figure 12:
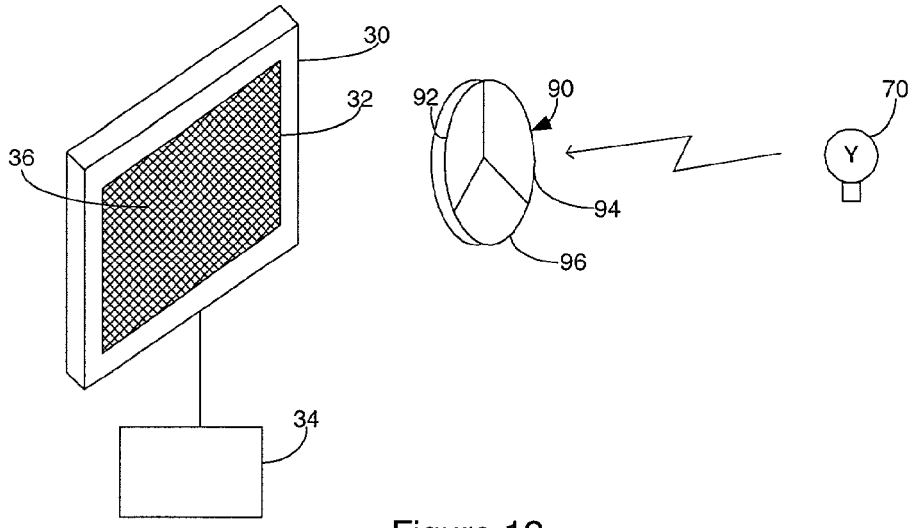
FIG. 12 is a perspective view of a simple display system based on a liquid crystal microdisplay and a color wheel included in the light source arrangement, which may include and be operated according to the teachings of the present invention.

As stated previously, the present invention may include a light source arrangement that utilizes a color wheel. Color wheels are more fully explained in copending U.S. patent application Ser. No. 09/923,920, filed Aug. 17, 2001, entitled, Color-Balanced Enhancement for Display Systems, which application is incorporated herein by reference in its entirety. Attention is directed to FIG. 12 which illustrates a display system including a color wheel 90. The color wheel 90 is divided into color areas, one for each color to be displayed. In this example, the color wheel 90 is divided into red, green and blue color areas, 92, 94 and 96 respectively. The color wheel 90 is configured to rotate around its center axis and is placed in the light path between the light source device 70 and the display panel 30, such that light passes through a portion thereof, before reaching the display panel 30. The rotation is timed such that light shines through the red color area 92 during the red color segment of a field-sequential color frame, through the green color area 94 during the green color segment, and through the blue color area 96 during the blue color segment. During transition segments between color segments, light from adjacent color areas may illuminate the panel simultaneously. This condition, together with the non-negligible panel writing time, can result in the same type of color inaccuracies discussed previously with respect to FIG. 3. However, as explained previously with respect to FIG. 5, the present invention may be used in field-sequential color systems that include a color wheel in the light source arrangement to eliminate these color inaccuracies while efficiently utilizing the available light by inserting transition segments where the state of each pixel depends on the desired brightness for that pixel.

Figure 13:
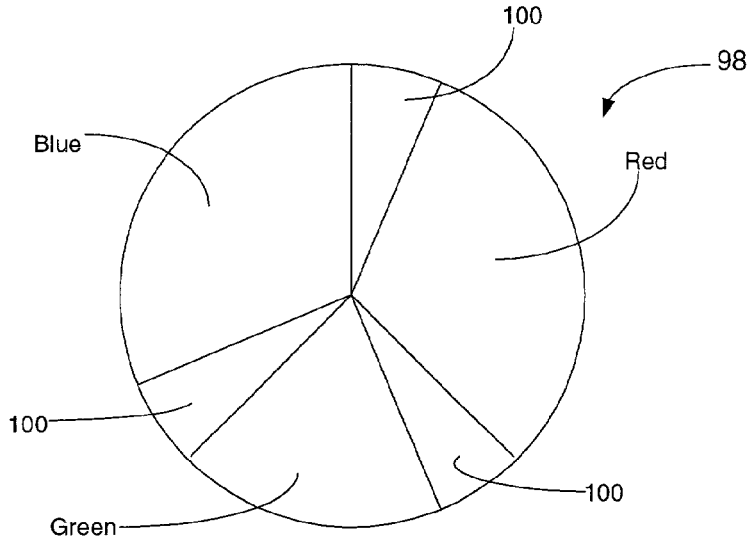
FIG. 13 is a plan view of a color wheel having a plurality of broadly-transmissive segments.

Attention is now directed to FIG. 13, which depicts a color wheel 98 having a number of additional broadly-transmissive areas 100. The invention may include one or more such areas, which are configured such that light passing therethrough illuminates the display panel during transition segments. This aspect of the invention may result in an even brighter image, since light passes though the broadly-transmissive areas 100 of the color wheel 98 essentially unfiltered, thus utilizing more of the available light.

In color wheel systems, it is further possible to vary the brightness of the combined light across all transition segments in a frame in a number of ways. In one example, the transmissivity of the broadly-transmissive area with respect to wavelength may be selected to provide the desired color temperature. However, because this method is fixed at the time of manufacture, it alone does not allow further operational adjustments.

Figure 14:
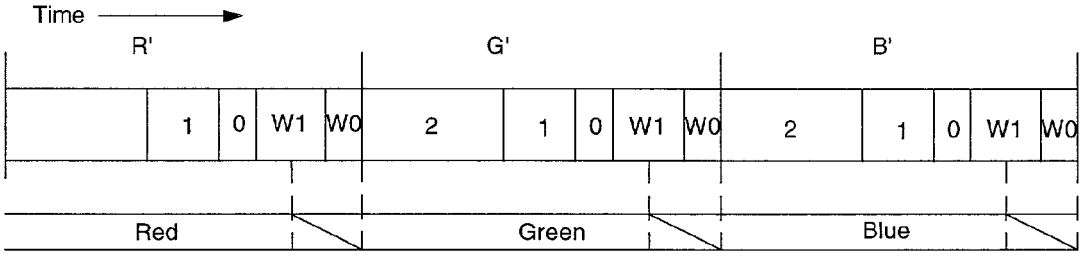
FIG. 14 is a timing diagram for a single frame in a field-sequential RGB color, 3-bit grayscale display system having a 2-bit grayscale transition segment.

In a second method for adjusting the color temperature, a color wheel system designed according to the present invention may include more than one W bit between each color segment. Such a system is illustrated in FIG. 14, which includes a single frame in a field-sequential RGB color, 3-bit grayscale system that includes a color wheel in the light source arrangement. This system of FIG. 14 is similar to the system of FIG. 6 discussed previously. While the system is shown as having two bits of grayscale during each transition period, the invention is not limited to a certain number of transition grayscale time periods. Bits W1 and W0 may be either ON or OFF in any particular transition period, such that up to four shades of transition period brightness may be produced. However, bits W1 and W0 must be in the same state in each transition segment in a particular frame to prevent color inaccuracies, since some amount of color from either side of each clear segment illuminates the panel during a transition period. Therefore, as will be clear in light of the teachings of the present invention, if corresponding transition bits are in the same state for each transition period in a particular frame, the integrated effect across the frame is an increase in brightness of the image with no color inaccuracies as a result of color transitions and little or no effect on the overall color balance of the system.

The foregoing description is considered as illustrative only of the principles of the invention. Furthermore, since numerous modifications and changes will readily occur to those skilled in the art, it is not desired to limit the invention to the exact construction and process shown and described above. For example, all or part of the teachings of the present invention may be applicable to other types of displays, including without limitation, nematic liquid crystal displays, digital micromirror displays, and others. Lastly, the present invention is also applicable to transmissive as well as reflective display systems. Accordingly, all suitable modifications and equivalents may be regarded as falling within the scope of the invention as defined by the claims that follow.

The invention claimed is:

1. A display, comprising:

a display panel, the panel having a plurality of pixels configured to modulate light in a temporal sequence so as to form an image during a frame, the pixels having a plurality of light modulating states, including OFF and ON;

a light source arrangement that illuminates the display panel, the light source arrangement being configured to selectively emit light of at least one of at least three different colors; and a data ordering arrangement that is receptive of incoming video data and that generates drive signals that drive the pixels to the light modulating states;

wherein the frame is divided time-wise into multiple color segments and multiple transition periods, the color segments being time periods where the light source arrangement emits, and illuminates the panel with, only one of the different colors of light, wherein between each two of the color segments is a transition period, the transition period being a time period where the light source arrangement emits, and illuminates the panel with, varying amounts of two of the at least three different colors of light, wherein the incoming video data includes information from which the data ordering arrangement determines pixel brightness values for each color segment, wherein the drive signals cause certain individual pixels to be in the same state other than the OFF state during each of the transition periods of a frame.

2. A display as defined in claim 1, wherein the number of color segments is at least three.

3. A display as defined in claim 2, wherein the light source arrangement illuminates the panel with red light during one color segment, green light during a different color segment and blue light during a different color segment.

4. A display as defined in claim 3, further comprising a compensator cell having at least two states, one state wherein the compensator has no effect on the appearance to a viewer of individual pixels, and a second state wherein the compensator changes the appearance of pixels by inverting the contrast of the image, and wherein the compensator changes from the first state to the second state at least once during the frame.

5. A display as defined in claim 4, wherein the compensator changes state during the color segment during which the light source is illuminating the display panel with blue light.

6. A display as defined in claim 1, wherein the intensity of the different colors of light illuminating the panel during the transition periods is adjustable to maintain a stable white point.

7. A display as defined in claim 1, further comprising a temperature sensing arrangement that senses the temperature of the light source arrangement, wherein the intensity of the different colors of light illuminating the panel during the transition periods is adjustable to maintain a stable white point in response to the temperature of the light source arrangement.

8. A display as defined in claim 1, wherein the light source arrangement includes color filters.

9. A display as defined in claim 1, wherein the light source arrangement includes a color wheel.

10. A display as defined in claim 9, wherein the color wheel is divided into at least three color areas.

11. A display as defined in claim 10, wherein the color wheel includes red, green and blue color areas.

12. A display as defined in claim 11, wherein the color wheel includes at least one broadly-transmissive area that passes a substantial amount of light across the visible light spectrum.

13. A display as defined in claim 12, wherein the color wheel includes at least one broadly-transmissive area between each color area.

14. A display as defined in claim 13, wherein the light illuminating the panel during a transition segment travels through a broadly-transmissive area of the color wheel.

15. A display as defined in claim 1, wherein the state of a pixel during the transition periods is determined by the pixel brightness values.

16. A display as defined in claim 15, wherein pixels with pixel brightness values above predetermined values for each color segment in a given frame are in a state other than OFF during the transition periods corresponding to the frame.

17. A display as defined in claim 15, wherein the color switching device is a color wheel.

18. A display as defined in claim 15, wherein the color switching device includes one or more color filters.

19. A display as defined in claim 15, wherein substantially the same drive signals are provided to the pixels by the data ordering arrangement during each transition period in a frame.

20. A display, comprising:

a display panel, the panel having a plurality of pixels configured to modulate light so as to form an image during a frame, the pixels having a plurality of light modulating states, including OFF and ON;

a light source arrangement that illuminates the display panel, the arrangement including a broad-spectrum source of light and a color switching device to control the color of light emitted by the arrangement, the light source arrangement being configured to selectively emit light of at least one of at least three different colors, a first color, a second color, and a third color; and a data ordering arrangement that is receptive of incoming video data and that generates drive signals that drive the pixels to the light modulating states;

wherein the frame is divided time-wise into color segments, the color segments being time periods where the light source arrangement emits, and illuminates the panel with, only one of the different colors of light, wherein between each two of the color segments is a transition period that is relatively shorter in time duration than the color segments, the transition period being a time period where the light source arrangement emits, and illuminates the panel with, varying amounts of two of the different colors of light there being one transition period during which varying amounts of the first and second color are emitted by the light source arrangement, a second transition period during which varying amounts of the second and third color are emitted by the light source arrangement, and a third transition period during which varying amounts of the first and third color are emitted by the light source arrangement;

wherein, depending on the incoming video data, the data ordering arrangement provides data to place certain pixels into an ON state during at least a portion of each of the transition periods to increase the amount of light in the displayed image, the increased light having a color that is a selected combination of the first, second, and third colors.

21. A display, comprising:

a display panel, the panel having a plurality of pixels configured to modulate light in a temporal sequence so as to form an image during a frame, the pixels having a plurality of light modulating states, including OFF and ON;

a light source arrangement that illuminates the display panel, the arrangement including a broad spectrum source of light and a color switching device to control the color of light emitted by the arrangement, the light source arrangement being configured to selectively emit light of at least one of at least three different primary additive colors, a first color, a second color, and a third color; and a data ordering arrangement that is receptive of incoming video data and that generates drive signals that drive the pixels to the light modulating states;

wherein the frame is divided time-wise into color segments, the color segments being time periods where the light source arrangement emits, and illuminates the panel with, only one of the different primary additive colors of light, wherein between each two of the color segments is a transition period that is relatively shorter in time duration than the color segments, the transition period being a time period where the light source arrangement emits, and illuminates the panel with, varying amounts of two of the different primary additive colors of light;

wherein, depending on the incoming video data, the data ordering arrangement provides data to place certain pixels into an ON state during at least a portion of each of the transition periods to increase the amount of light in the displayed image, the increased light having a color that is a selected combination of the first, second, and third colors.

* * * * *